US007670087B1

(12) United States Patent
Burkett

(10) Patent No.: US 7,670,087 B1
(45) Date of Patent: Mar. 2, 2010

(54) SHEET PILING WALL HAVING FACADE

(76) Inventor: Darryl Scott Burkett, c/o Riverwalls, Ltd., P.O. Box 562, Barrington, IL (US) 60011

( * ) Notice: Subject to any disclaimer, the term of this patent is extended or adjusted under 35 U.S.C. 154(b) by 0 days.

(21) Appl. No.: 11/329,383

(22) Filed: Jan. 10, 2006

Related U.S. Application Data

(60) Provisional application No. 60/642,667, filed on Jan. 10, 2005.

(51) Int. Cl.
*E02D 5/02* (2006.01)

(52) U.S. Cl. ..... 405/274; 405/279

(58) Field of Classification Search ..... 405/274, 405/275, 279
See application file for complete search history.

(56) References Cited

U.S. PATENT DOCUMENTS 635,165 A 10/1899 Weyhe
1,925,417 A * 9/1933 Swank ..... 52/284
5,274,975 A * 1/1994 Haag ..... 52/300
5,433,047 A * 7/1995 Wallace et al. ..... 52/284
5,447,393 A 9/1995 Yeates et al.
6,053,666 A 4/2000 Irvine et al.
6,226,936 B1 5/2001 Grossman
6,350,084 B2 2/2002 Grossman
6,352,230 B2 3/2002 Grossman

FOREIGN PATENT DOCUMENTS

FR 2732375 10/1996

* cited by examiner

*Primary Examiner*—Tara Mayo-Pinnock
(74) *Attorney, Agent, or Firm*—Erickson Law Group, PC

(57) ABSTRACT

A wall for retaining water includes a backing support, formed by vertically arranged sheet piling, a base attached to the sheet piling, and a rock or boulder facade supported on the base. The sheet piling is formed of undulating, interlocking steel sheets. A backing plate is welded to the sheet piling. A high quality plaster is applied between the facade and the backing plate and between the backing plate and the sheet piling. Preferably, the plaster is a pool plaster type, typically used to seal cracks and form an exposed surface in in-ground swimming pools.

19 Claims, 5 Drawing Sheets

SHEET PILING WALL HAVING FACADE

RELATED APPLICATIONS

This application claims the benefit of provisional application U.S. Ser. No. 60/642,667, filed Jan. 10, 2005.

TECHNICAL FIELD OF THE INVENTION

The present invention relates to walls constructed by sheet piling. Particularly, the present invention relates to a wall formed by a continuous steel sheet wherein the steel wall supports a boulder or stone facade, wherein the wall is particularly adapted to function as a dam, revetment, spillway or bank support.

BACKGROUND OF THE INVENTION

Walls formed of steel sheet piling that support a facade are known. Such walls are described for example in U.S. Pat. No. 635,165, or French Patent FR 2732375.

Walls for retaining water formed of sheet piling with a rock facade can suffer the drawback that water can infiltrate behind the rock facade and freeze during cold temperatures. The freezing water expands away form the sheet piling and pushes the facade away from the sheet piling. After repeated freezing and thawing events, the facade can eventually be pushed away from the sheet piling and the wall can fail.

SUMMARY OF THE INVENTION

The present invention provides an improved wall for retaining water that can be economically constructed and used for dams, waterfalls, spillways, shoreline stabilization, and revetments. The wall can be installed using relatively compact construction equipment such that the wall can be installed in hard-to-access areas such as areas inside golf courses. The invention provides a wall that is long lasting and resists problems associated with freezing water.

The present invention provides a wall that comprises a wall structure, formed by vertically arranged sheet piling, a base attached to the sheet piling, and a rock or boulder facade supported on the base. According to the invention, the sheet piling is formed of undulating, interlocking steel sheets. A backing plate is welded to the sheet piling. A high quality plaster is applied between the facade and the backing plate and between the backing plate and the sheet piling. Preferably, the plaster is of the type typically used to seal cracks in in-ground swimming pools.

The configuration of the present invention seals effectively against water infiltration and freezing between the facade and the sheet piling which over time can cause cracking and separation of portions of the facade from the sheet piling.

According to another aspect of the invention, an over cap can be supported above the facade wherein in the case of a waterfall, the water flows over the facade within a gap formed between the facade and the over cap. The over cap provides a useful dry top surface on top of the waterfall. For example, articles could be placed or supported on the surface. The arrangement provides an aesthetically attractive waterfall.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
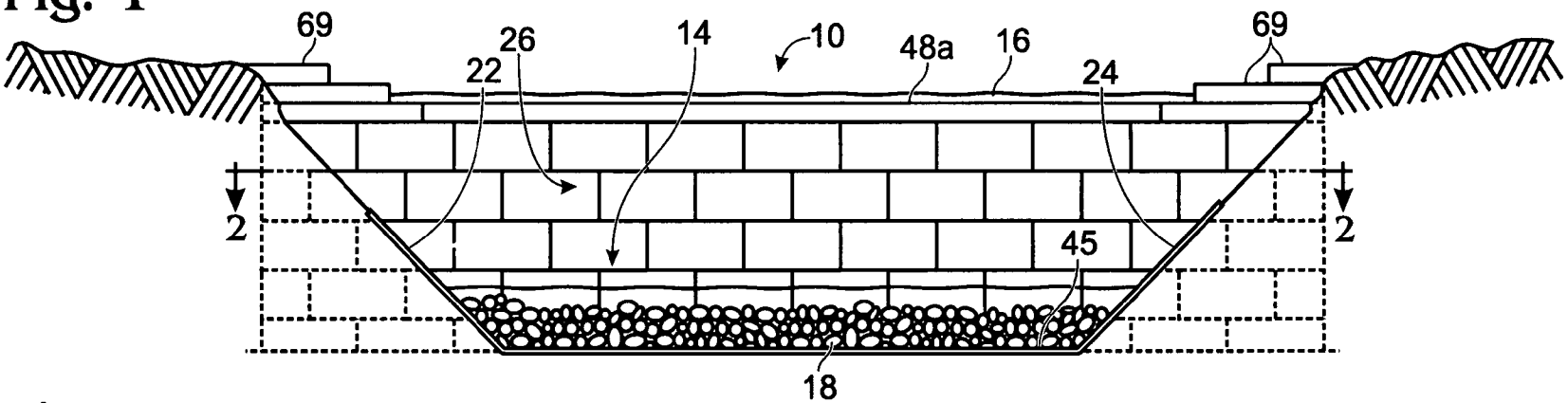
FIG. 1 is a front view of a wall constructed in accordance with the invention.
Figure 2:
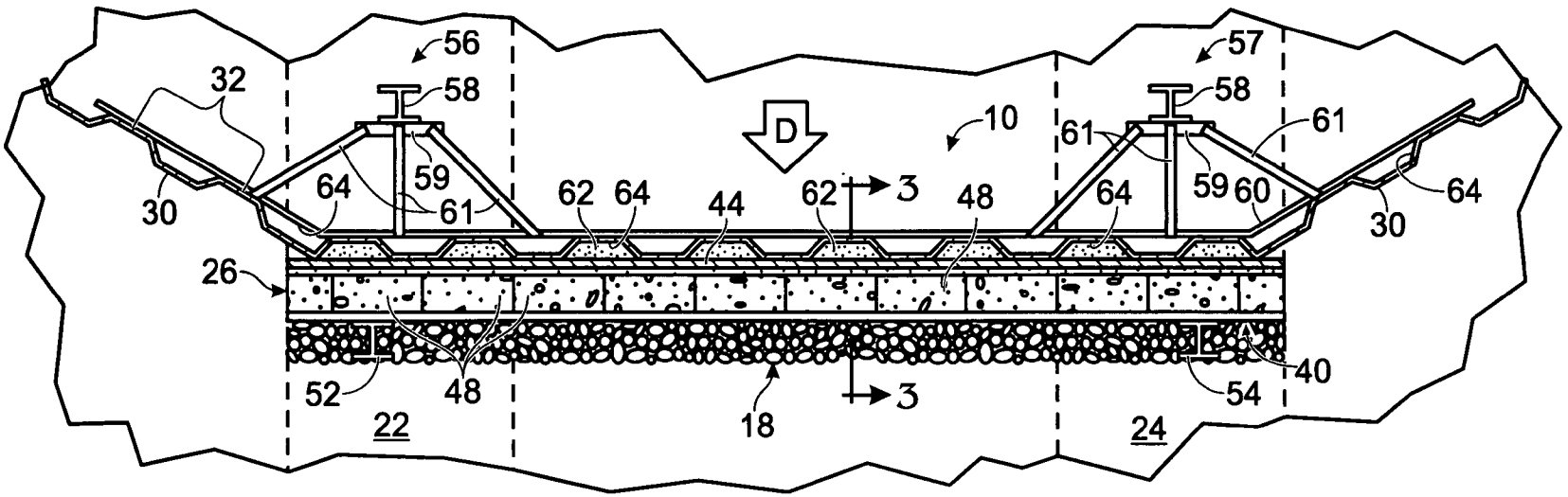
FIG. 2 is a sectional view taken generally along line 2-2 of FIG. 1.
Figure 3:
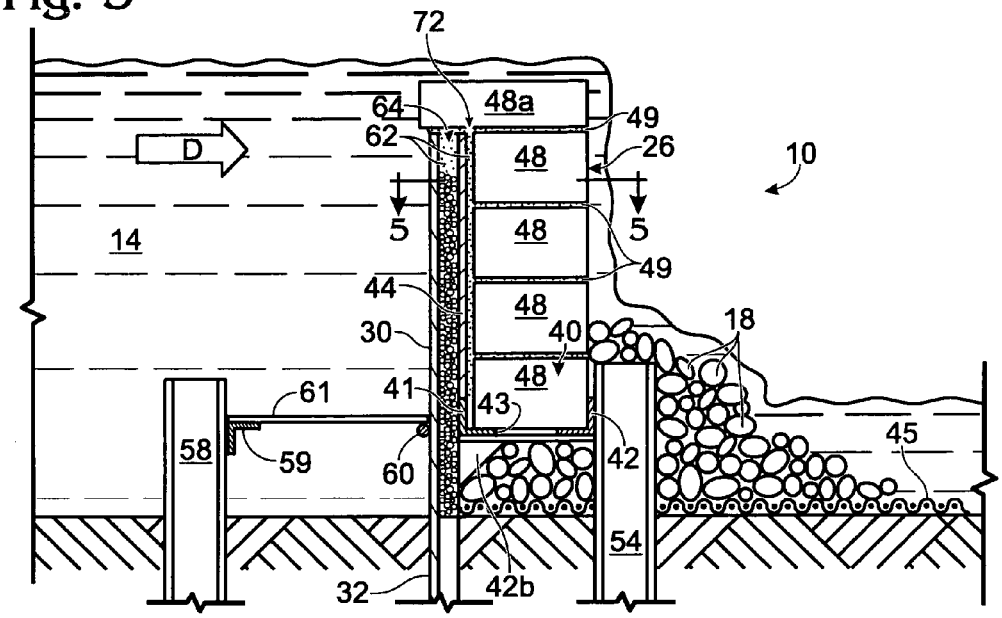
FIG. 3 is a sectional view taken generally along line 3-3 of FIG. 2.
Figure 5:
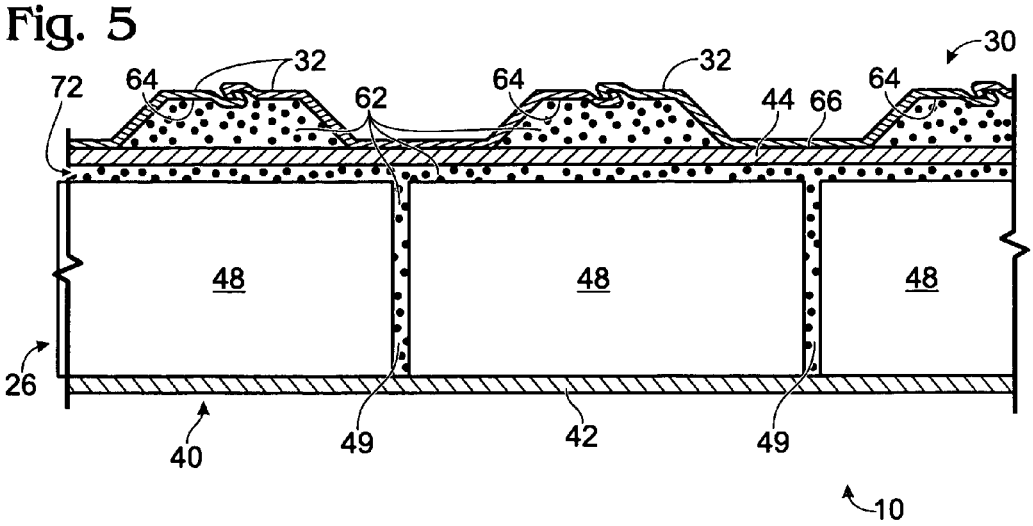
FIG. 5 is an enlarged, fragmentary sectional view taken generally along line 5-5 of FIG. 3.
Figure 4:
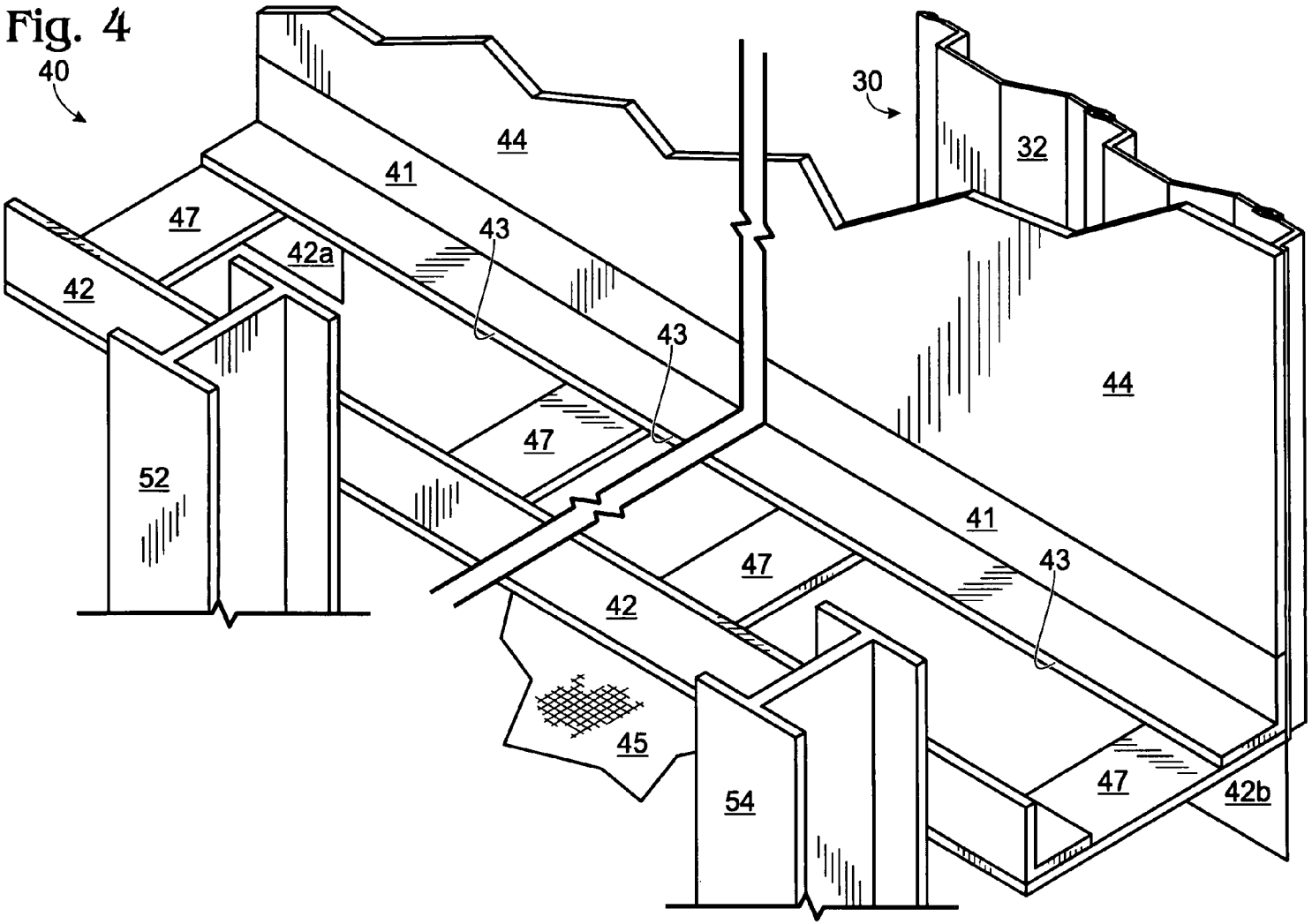
FIG. 4 is a fragmentary perspective view of a portion of the wall, shown during construction before a rock facade is assembled.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a wall 10 of the invention in the form of a dam or waterfall, traversing a creek 14. A level of water 16 spills over the wall 10 onto a rock bed 18 arranged in front of the wall 10. The wall 10 is set into the left bank 22 and the right bank 24 of the creek 14. The wall 10 includes a rock or boulder facade 26.

FIGS. 2-5 illustrate the construction of the wall 10 in more detail. The water flow in the creek is in the direction "D". The wall 10 includes a length of steel sheet piling 30. The sheet piling 30 is typically driven into the ground to refusal, typically about 3-5 feet.

The sheet piling 30 is formed of individual sheets 32 that include interlocking edges (FIG. 5) as is known. The sheet piling can be commercially available 8-gauge sheet piling. U.S. Pat. Nos. 5,447,393 and 6,053,666 illustrate examples of sheet pile configurations, and are herein incorporated by reference. The sheet piling is set back into the banks 22, 24 and beyond for stability and erosion prevention.

A base frame 40 includes (2) horizontally arranged 3×3 inch structural steel angles 41, 42 open upwardly and toward each other to form a channel with a bottom gap or opening 43. The angles 41, 42 are supported on two or more knee brackets 42*a*, 42*b* welded to the sheet piling 30 and each comprising a structural steel angle with a welded 45 degree gusset plate. Three cross braces 43 bridge between the angles 41, 42, to rigidify the frame 40. The cross braces can also be 3×3 inch structural steel angles. The base frame 40 is about 10 inches wide.

The bottom opening 43 of the base frame 40 has a span of about 6 inches, measured perpendicular to the wall 10. The facade 26 is formed of blocks 48, comprising rocks, stones, boulders, or the like. The bottom course of blocks 48 has a sufficient depth to span this opening 43 in the base frame 40.

A backing plate 44 extends upwardly from the base frame 40 to a top of the sheet piling 30 and is welded to the base frame and to the sheet piling.

An erosion-prevention woven fabric 45 is placed downstream of the sheet piling 30 in the creek bed and covered with the rock pile 18. This fabric helps to prevent wash-out and scouring caused by action of the waterfall. The rock bed 18 also fills in beneath the base frame 40.

In front of the base frame 40, a pair of column piles 52, 54 are driven into the ground to the point of refusal, typically about 4-5 feet deep. The column piles 52, 54 are welded to the front angle 42 and buried by the rock pile 18. The column piles 52, 54 are preferably 4×6 inch, 9 pounds/foot steel I-beams or WF beams.

Two "deadman" anchor systems 56, 57 are utilized. Each system 56, 57 includes an I-beam or WF column pile 58 driven to refusal, typically 8 feet deep. A cross brace 59 is welded to the pile column 58. The cross braces can each be a 4×4 inch steel angle.

A waler 60, typically a ¾ inch diameter steel rod, is welded to the back of the sheet piling 30. Three tie back rods 61 are welded to the cross brace and the waler and arranged as illustrated. The tie back rods 61 can be ¾ inch diameter steel rods.

Preferably the steel components, such as the sheet piling 30, the base 40, the backing plate 44 and the column piles 52, 54 have a thickness, such as 0.164 to 0.25 inches, that is sufficient for strength and to have a suitable service life depending on the corrosiveness of the soil and water conditions.

Washed gravel is filled into the voids 64 formed between the undulations of the sheet piling 30 and the backing plate 44 up to about 6 inches below the top of the backing plate and the sheet piling. A pre-selected plaster 62 is poured or packed into the voids 64 formed between the undulating sheet piling 30 and the backing plate 44, above the washed gravel. The plaster can be also be applied in the narrow seams 66 where the sheet piling meets the backing plate 44, as necessary.

The facade 26 is formed by setting a base course on the base frame 40 and building up from there to a top of the backing plate 44 with a top course or cap 48*a* overlying the backing plate and sheet piling. The facade 26 has substantially the same height and width as the backing plate 44, except for the top course of the facade, which overlies the backing plate 44. Step blocks 69 can be partially set into the bank to control the edges of the water fall.

Preferably the blocks 48 are dry set, cut dry wall stones, or snap masonry stones, 5½ inches thick by 9 inches deep by 10-20 inches random lengths, and are stacked in courses on the base frame 40, with staggered vertical joints. The first course is pulled forward to the front vertical leg of the front angle 42. Mortar is applied throughout the joints 49 between blocks 48. Preferably the mortar is a type M frost-proof cement with a 2:1 mixture of cement and sand. One such mortar is a LAFARGE Type M, High Strength Mortar Mix, available from LaFarge North America, Inc.

The top course 48*a* of the rock facade is preferably Indiana limestone, rock faced on both sides. Typically the top course stones are 16 inches wide by 2⅜ inches thick by 8-16 feet long.

The special plaster 62 can also be applied between the facade 26 and the backing plate, along the interface 72.

According to the preferred embodiment of the invention, the plaster 62 is DIAMOND BRITE, available from Southern Grout and Mortar Incorporated of Pompano Beach, Fla., USA. This special plaster is known as "pool plaster." This plaster has heretofore been applied (using a GUNNITE spray method) to a cement base to a smooth outer finish, the exposed surface finish, for in-ground swimming pools. It has been recognized by the inventor that this high quality plaster and similar products substantially reduces the cracking and displacement of blocks caused by freezing and thawing, and will substantially increase the life of the wall. The pool plaster prevents water pockets and resultant freeze pressure from cracking the mortar. The pool plaster is applied between all voids between stone and steel.

The wall of the present invention can be installed without the need for heavy construction equipment, which could damage delicate terrain such as found within a golf course. In this regard the sheet piling can be driven by an apparatus described in U.S. Pat. No. 6,966,448, herein incorporated by reference.

Figure 6:
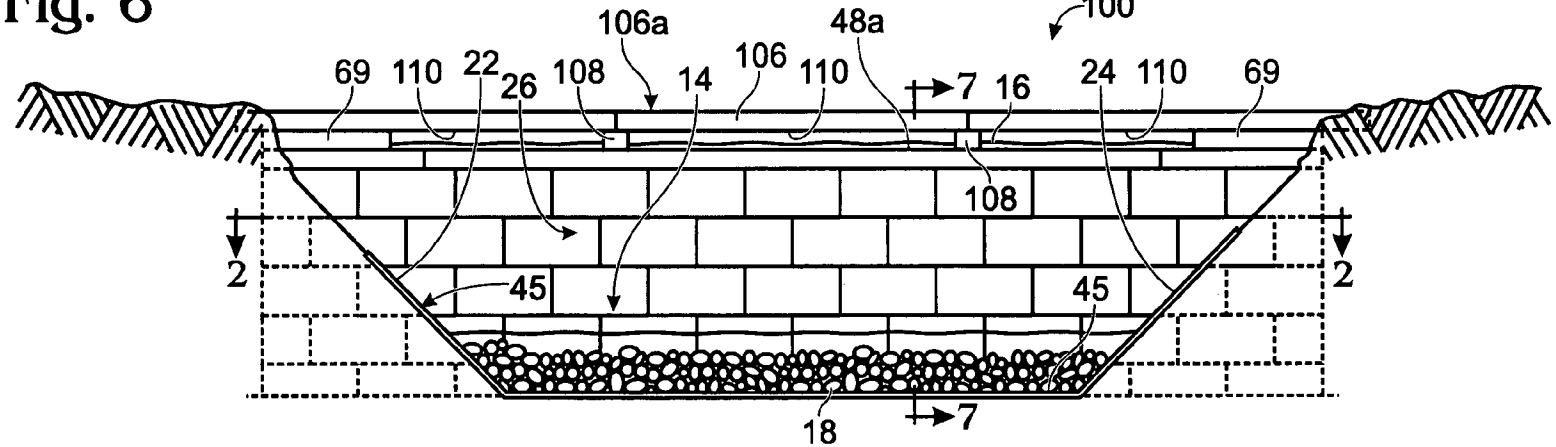
FIG. 6 is a front view of a modified wall constructed in accordance with the invention.
Figure 8:
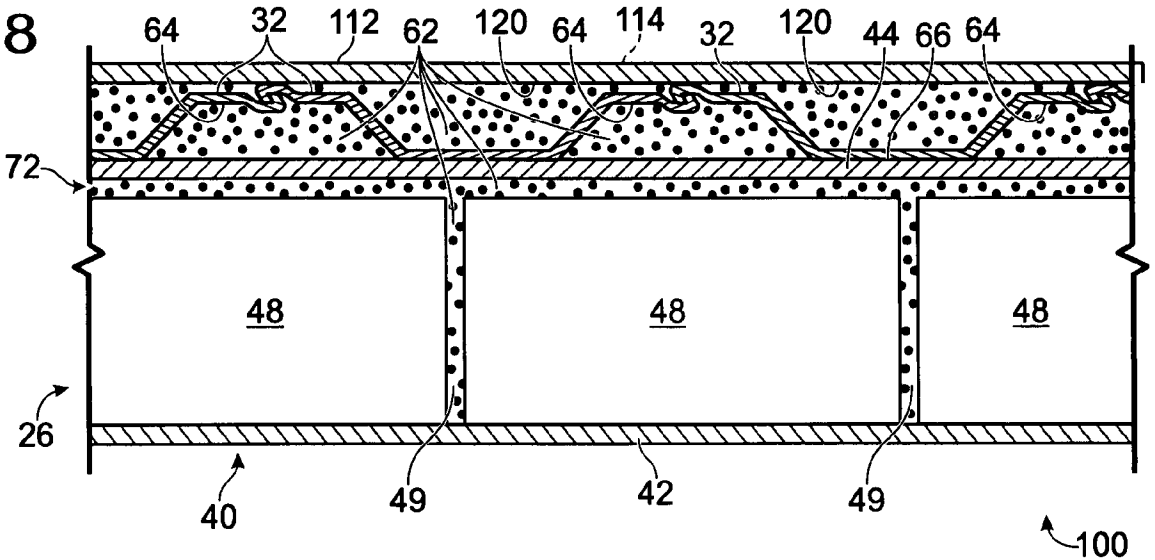
FIG. 8 is a sectional view taken generally along line 8-8 of FIG. 7.
Figure 7:
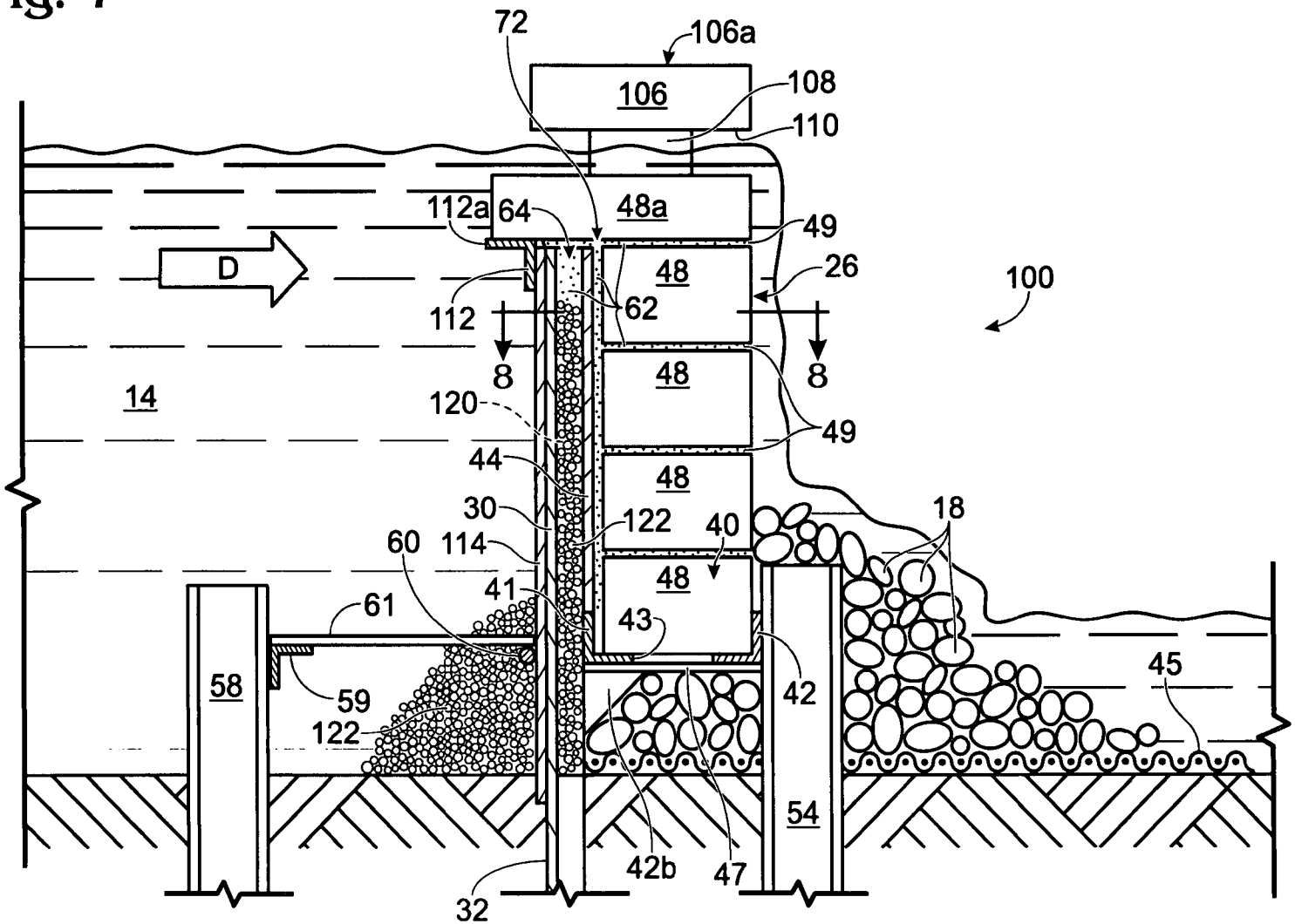
FIG. 7 is a sectional view taken generally along line 7-7 of FIG. 6.

FIGS. 6 through 8 illustrate a modified wall 100 according to the invention. The wall is identical to the wall 10 described in FIGS. 1-5 in construction and materials except as noted. Identical features carry the same reference numbers. According to this embodiment an over cap 106 is supported at its ends by the step blocks 69 and as necessary an intermediate block 108. The intermediate support block 108 can have a streamlined shape to minimize interference with a smooth water flow over the cap 48*a*. The over cap 106 can be of the same material stock as the cap 48*a*. The over cap 106 is set above the cap 48*a* to create a rectangular gap 110 through which the water can flow over the cap 48*a* while maintaining a dry surface 106*a*. The water flowing through the gap 110 is aesthetically attractive. The over cap provides a useful dry top surface on top of the waterfall. For example, articles could be placed or supported on the surface.

The over cap 106 can be set into the bank at its ends. For an increased gap height more than one course of step blocks 69 and intermediate block 108 can be used to support the over cap 106.

FIGS. 7 and 8 illustrate that a 4 inch by 4 inch angle 112 is welded along a top and bottom of the angle to a back side of the sheet piles 32. A closure plate 114 (FIG. 7) is welded to a back side of the sheet piles 32 and continuously to a bottom of the angle 112. The closure plate has a height of about one foot. The angle 112 and the closure plate 114 close a back side of the sheet piling undulations creating voids 120 having open top and bottom ends. The bottom ends are effectively closed by a washed gravel fill 122 or other fill. The gravel is filled into the voids 120 up to about 6 inches below the top of the backing plate 44 and the sheet piling 30. The plaster 62 is poured or packed into the voids 120 above the washed gravel 122.

The plaster 62 is also used to seal the interface between the cap 48*a* and the top leg 112*a* of the angle 112. The plaster can be built up at an angle to seal against a back face of the cap 48*a* to prevent water from penetrating between the cap 48*a* and the angle 112 where freezing can induce cracking or dislodgement of the cap 48*a*.

The provision of the angle 112 prevents ice from exerting an upward thrust on the overhanging rear portion of the cap 48*a* and cracking the cap 48*a*.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A composite wall for retaining a body of water, comprising:

a plurality of corrugated metal sheet piles, driven into the ground and connected together to form an undulating wall structure;

a base connected to said wall structure and extending therefrom horizontally, said base comprising a steel base frame that is connected to the wall structure and extends away from the wall structure;

a backing plate secured to the wall structure and having a vertical surface facing away from the wall structure, said backing plate closing said undulating wall structure, forming spaced apart, vertically extending voids between said undulating wall structure and said backing plate;

a plurality of blocks stacked directly on top of said base, such that a weight of the blocks bears directly on the base frame, and forming a facade adjacent said vertical surface of said backing plate; and a first setting material filling said voids formed between the undulating wall structure and the backing plate, preventing water from penetrating into said voids through an upper end of said voids.

2. The wall according to claim 1, wherein said first setting material comprises pool plaster.

3. The wall according to claim 1, comprising a second setting material applied between said facade and said vertical surface.

4. The wall according to claim 3, wherein said second setting material comprises a pool plaster.

5. The wall according to claim 4, wherein said first setting material comprises a pool plaster.

6. The wall according to claim 1, wherein said facade and said backing plate have substantially equivalent bottom elevations.

7. The wall according to claim 6, wherein a surface area of said facade is substantially coextensive with said vertical surface area.

8. The wall according to claim 1, wherein said backing plate is welded to said wall structure and said first setting material comprises a pool plaster;

a second setting material applied between said facade and said vertical surface, wherein said first and second setting materials comprise pool plaster;

wherein said facade and said backing plate have substantially equivalent bottom elevations; and a surface area of said facade is substantially coextensive with said vertical surface area.

9. The wall according to claim 8, wherein said blocks comprise cut stones and comprising a mortar applied between joints and courses of the stones.

10. The wall according to claim 1, wherein said blocks comprise cut stones and comprising a mortar applied between joints and courses of the stones.

11. The wall according to claim 1, wherein said backing plate is welded to said wall structure.

12. The wall according to claim 1, comprising an over cap supported by said wall structure and spaced above said facade forming a gap between said over cap and said facade.

13. A composite wall for retaining a body of water, comprising:

a plurality of metal sheet piles, driven into the ground and connected together to form a wall structure;

a base comprising a steel base frame extending along said wall structure and connected to said wall structure and extending therefrom horizontally and away from the wall structure;

a plurality of blocks stacked directly on top of said base, such that a weight of the blocks bears directly on the base frame, and forming a facade adjacent said metal sheet piles; and a pool plaster material filling voids formed between the wall structure and the façade, preventing water from entering the voids from a top end of said voids.

14. The wall according to claim 13, wherein said wall structure comprises an undulating vertical surface and voids formed between said undulating wall surface and said facade are filled by said pool plaster material.

15. The wall according to claim 14, comprising a backing plate secured to the wall structure between the facade and the wall structure and having a vertical surface facing away from the wall structure; and pool plaster material applied between said facade and said vertical surface.

16. The wall according to claim 15, wherein said facade and said backing plate have substantially equivalent bottom elevations; and a surface area of said facade is substantially coextensive with said vertical surface area.

17. The wall according to claim 16, wherein said blocks comprise cut stones and comprising a mortar applied between joints and courses of the stones.

18. The wall according to claim 13, wherein said blocks comprise cut stones and comprising a mortar applied between joints and courses of the stones.

19. The wall according to claim 13, comprising an over cap supported by said wall structure and spaced above said facade forming a gap between said over cap and said facade.

* * * * *